US007222022B2

(12) United States Patent
Kneissl et al.

(10) Patent No.: US 7,222,022 B2
(45) Date of Patent: May 22, 2007

(54) METHOD OF DETERMINING PROPERTIES RELATING TO AN UNDERBALANCED WELL

(75) Inventors: Wendy Kneissl, Duxford (GB); Yan Kuhn De Chizelle, Bougival (FR)

(73) Assignee: Schlumberger Technology Corporation, Ridgefield, CT (US)

( * ) Notice: Subject to any disclaimer, the term of this patent is extended or adjusted under 35 U.S.C. 154(b) by 306 days.

(21) Appl. No.: 10/333,283

(22) PCT Filed: Jul. 13, 2001

(86) PCT No.: PCT/GB01/03216

§ 371 (c)(1),
(2), (4) Date: Jan. 8, 2004

(87) PCT Pub. No.: WO02/06634

PCT Pub. Date: Jan. 24, 2002

(65) Prior Publication Data

US 2004/0111216 A1 Jun. 10, 2004

(30) Foreign Application Priority Data

Jul. 19, 2000 (GB) ..... 0017754.3
Oct. 5, 2000 (GB) ..... 0024331.1

(51) Int. Cl.
*G01V 1/40* (2006.01)
*G01G 7/48* (2006.01)

(52) U.S. Cl. ..... 702/12; 703/5

(58) Field of Classification Search ..... 702/1–12; 175/48, 25; 703/5
See application file for complete search history.

(56) References Cited

U.S. PATENT DOCUMENTS 2,293,904 A * 8/1942 Kail ..... 166/250.14
3,517,553 A * 6/1970 Crownover, Jr. et al. ..... 73/152.22
3,552,502 A * 1/1971 Wilson, Sr. ..... 175/25
3,827,511 A * 8/1974 Jones ..... 175/25

(Continued)

FOREIGN PATENT DOCUMENTS

EP 0 171 933 A1 7/1985

(Continued)

OTHER PUBLICATIONS

Kardolus et al Formation testing while underbalanced drilling SPE 38754, 1997, pp. 521-528.

*Primary Examiner*—Bryan Bui
*Assistant Examiner*—Victor J. Taylor
(74) *Attorney, Agent, or Firm*—Steven Gahlings; Edward M. Bushard; Jody Lynn DeStefanis

(57) ABSTRACT

There is a method of determining properties relating to an underbalanced well, comprising inducing pressure variations in a fluid within a well, measuring the pressure variations, and calculating pore pressure of at least one fluid-producing formation. The pressure variations cause a change in flow rate from formations along a length of borehole, and as such a change in the production flow rate of the well. The variations in pressure are used to calculate the pore pressure. Variations in annular bottomhole pressure are induced by altering the flow rate of drilling fluid, or the density of drilling fluid or by acoustic pulsing downhole. The pore pressure, permeability and porosity of the formations is derived as a real time profile along the length of the borehole.

29 Claims, 7 Drawing Sheets

U.S. PATENT DOCUMENTS

| | | | | |
|---|---|---|---|---|
| 3,871,218 | A | 3/1975 | Louis | 73/152.41 |
| 5,214,251 | A * | 5/1993 | Orban et al. | 181/102 |
| 5,220,504 | A | 6/1993 | Holzhausen et al. | 702/12 |
| 5,337,821 | A | 8/1994 | Peterson | 166/250.07 |
| 5,354,956 | A * | 10/1994 | Orban et al. | 181/105 |
| 6,484,816 | B1 * | 11/2002 | Koederitz | 175/25 |
| 6,659,197 | B2 * | 12/2003 | Cooper | 175/48 |
| 6,941,804 | B2 * | 9/2005 | Hasem et al. | 73/152.24 |

FOREIGN PATENT DOCUMENTS

| | | | |
|---|---|---|---|
| EP | 0 339 752 | A1 | 4/1989 |
| EP | 0 386 810 | A2 | 2/1990 |
| GB | 1 579 785 | | 9/1977 |
| GB | 2 161 943 | A | 7/1985 |
| WO | 99/00575 | A2 | 6/1998 |

* cited by examiner

Processed data; re-gridding method was average$_t$, Naverage = 19.7

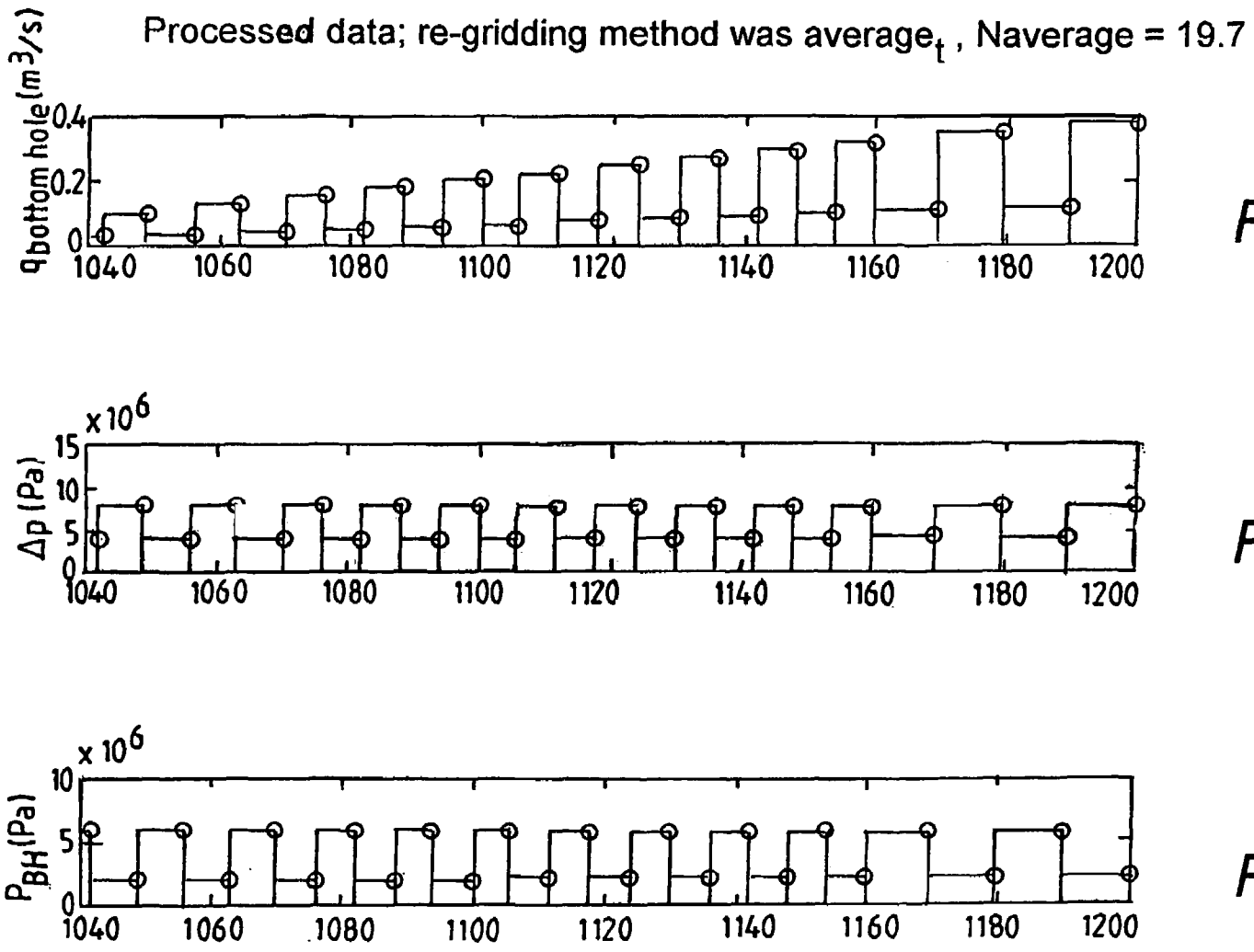
Fig. 4(a) [Prior Art]
Fig. 4(b) [Prior Art]
Fig. 4(c) [Prior Art]

Processed data; re-gridding method was average$_t$ , Naverage = 19.7

METHOD OF DETERMINING PROPERTIES RELATING TO AN UNDERBALANCED WELL

FIELD OF THE INVENTION

The invention relates a method of determining properties relating to an underbalanced well, and in particular deriving properties such as pore pressure, permeability and porosity for fluid-producing formations contributing to fluid output from the well.

BACKGROUND TO THE INVENTION

Boreholes are sometimes drilled using drilling fluid which has a pressure substantially less than the pressure of the fluid from the formation. This is known as underbalanced drilling. Underbalanced drilling is often used where fluid-bearing formations are known to be delicate and prone to damage, so as to maintain the integrity of the formation. Typically a number of different subterranean structures, with different properties, are drilled through before the actual production formation of interest is reached. The pressure of fluid from the formation will often therefore vary during drilling. It is often important to ensure that the drilling remains underbalanced at all times to minimise formation damage.

Underbalanced drilling is also used generally where, for example, faster drill speeds are required or where the life of a drill bit needs to be extended.

The formations surrounding the borehole can be characterised by a pore pressure, porosity and permeability. When underbalanced drilling, an estimate of the pore pressure is typically made, and the pressure of the drilling fluid is then chosen in an attempt to ensure that underbalanced drilling is achieved at all times. However, the estimates of pore pressure are generally very inaccurate and as such it is often difficult to perform underbalanced drilling with any degree of reliability or control.

The estimate of pore pressure can be used to derive the permeability of the formations, but the estimated pore pressure can be very inaccurate so causing errors in the values of permeability.

The present invention aims to provide a method which supplies more information about formations whilst drilling and aims to enable more controlled underbalanced drilling to be achieved.

SUMMARY OF THE INVENTION

In accordance with the present invention, there is provided a method of calculating properties relating to a subterranean formation. The method comprises drilling a borehole into the subterranean formation; measuring a first pressure in the borehole and a first fluid flow rate when the drilling has progressed to the first location; measuring a second pressure in the borehole and a second fluid flow rate when the drilling has progressed to the second location; and calculating a property of at least a portion of the formation using the first and second pressures and the first and second fluid flow rates.

The fluid flow rates can be measured as the fluid exits the borehole at or near the surface, or may be measured in close proximity to the drill bit. The pressure measurements are preferably of annular bottomhole pressures. The step of calculating preferably comprises calculating at least two of the following types of properties: pore pressure, porosity, and permeability.

The method can also preferably include a third set of measurements taken when the drilling has progressed to a third location in the formation, and the step of calculating further comprises calculating all three of the following properties: pore pressure, porosity, and permeability.

Variations in pressure in the borehole can be induced by various methods, including one or more of the following: altering the flow rate of drilling fluid; placing a tool in the borehole which emits acoustic pulses into fluid within the well; altering the density of drilling fluid used; use of a choke unit. However, variations in pressure can also be caused by unintentional variations in pumping of drilling fluid.

The step of calculating preferably comprises using a first relationship between the first flow rate and the first pressure, a second relationship between the second flow rate and the second pressure, and solving the first and second relationships to obtain a value for the property, with the first and second relationships preferably expressing the measured flow rates as a function of drawdown, rate of penetration, and the rate response of a portion of the formation.

Advantageously, the step of drilling is preferably not interrupted during the measurement steps.

The present invention is also embodied in a system for calculating properties relating to a subterranean formation, comprising: a pressure sensor configured to measure pressures in a borehole in the formation in close proximity to a drill bit used to drill the borehole; a flow sensor configured to measure flow rates of fluid flowing through the borehole; and a processor adapted to calculate a property of at least a portion of the formation using first and second measured pressures and first and second fluid flow rates, wherein the first and second pressures are measured by the pressure sensor when the drilling has progressed to a first and second location respectively, and the first and second flow rates are measured by the flow sensor when the drilling has progressed to a first and second location respectively.

As used herein, the term "induce" when referring to pressure variations includes both intentional and unintentional changes in pressure. For example, the induced pressure changes can be caused by uncontrolled variations in the drilling fluid pumping speeds, or other "noise" in the form of unintentional pressure variations induced by the drilling process.

The pressure variations cause a change in flow rate from formations along a length of borehole, and as such a change in the production flow rate of the well. The variations in pressure can be used to calculate the pore pressure.

The variation in annular bottomhole pressure causes changes in the flow rate from the formations and as such the production flow rate, i.e. the total output of the well, changes. The variations in production flow rate allow analysis of the profile of the formations along the length of the borehole. By monitoring pressure variations over a small distance of drilled borehole over which distance one can assume that properties of the reservoir remain constant, and by correlating the changes in production flow rate with pressure variations, pore pressure for formations over the given length can be determined. The method thus avoids the need to estimate pore pressure, and instead provides a way of calculating a true pore pressure much more accurately. As drilling proceeds, monitoring of the pressure variations continues and with the changes in production flow rate, a profile of pore pressure along the length of the borehole is obtained. Thus, if desired, real time measurements conducted whilst drilling can be used to create a real time profile of the pore pressure and, where desired, also porosity. Permeability may also be derived.

By obtaining a profile of pore pressure along the length of the borehole, and not using an estimate or assumption of the pore pressure, the properties of the formation are known with a great deal of resolution.

By using a real time profile, a number of advantages are achieved in that the pore pressure of the well is constantly monitored as drilling occurs. Typically formations where underbalanced drilling is required have a pressure of around 10 MPa and thus the induced pressure variations are preferably kept in the range 2 MPa–5 MPa so as to ensure that the drilling is kept underbalanced. Thus it can be guaranteed that drilling is underbalanced at all times.

Permeability steering can also be undertaken, and as the properties of the formation are known along its length, the need for testing the well after drilling, and the need to shut down the well, when testing, can be avoided.

Productivity steering is also possible where the well is redesigned during drilling based on the measurements obtained, so maximising productivity. The method in accordance with the invention may also be used in a variety of other well operations, including during completion of a well and for targeted, or intelligent, perforating of the well.

The invention is also of advantage in that permeable zones and damaged zones are identified with a great degree of accuracy, and as such it is simpler to identify where casings and cement need to be perforated when completing the well. The invention also allows benchmark testing as drilling occurs.

In accordance with another aspect of the invention, there is provided apparatus for performing the above described method.

BRIEF DESCRIPTION OF THE DRAWINGS

The invention will now be described by way of example and with reference to the accompanying drawings in which.

DETAILED DESCRIPTION OF THE INVENTION

Figure 1:
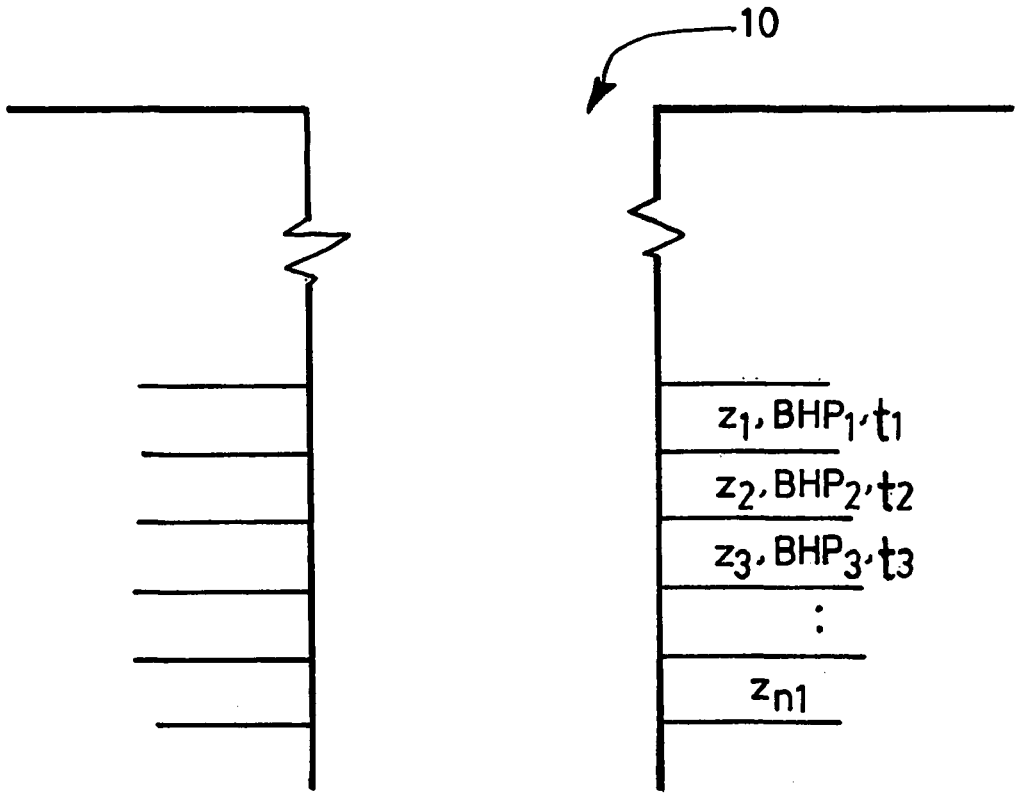
FIG. 1 shows a schematic view of a section through a borehole, and used for explanation.

FIG. 1 illustrates a borehole 10 which has been artificially divided along its length into a series of layers $z_1, z_2, z_3 \ldots z_n$. As long as drilling occurs at a suitable rate, one can assume that the change in properties of the formations along the borehole are negligible over small distances. By artificially dividing the borehole along its length into formation layers at successive distances of $z_1, z_2, z_3 \ldots z_n$, one can assume for layer $z_1$, drilled at annular bottomhole pressure $BHP_1$ at a time $t_1$ and formation $z_2$, drilled at annular bottomhole pressure $BHP_2$ and at time $t_2$, that the properties of the two formations $z_1, z_2$ are constant and that any changes in the production flow rate or flux from the well are as a result of the change in pressure. This allows one to solve two simultaneous equations relating to the properties of these artificial layers to deduce the pore pressure of fluid in the reservoir for layers $z_1$ and $Z_2$ and also the permeability of the permeable rock forming layers $z_1$ and $Z_2$.

By measuring a further pressure change for layer $Z_3$, three simultaneous equations are arrived at and these can be solved for the three variables of pore pressure, i.e. pressure of fluid in the reservoir, permeability and porosity. Permeability and porosity are both properties of the permeable rock. By conducting an analysis in this way, and subdividing the length of the borehole into a series of impedances, an accurate profile of the true properties of the formations along the length of the borehole is obtained.

The method described derives formation pressure for underbalanced drilling of a reservoir where the well is drilled such that the pressure within the wellbore is below the formation pressure of the reservoir. During drilling, a continual influx of formation fluid occurs into the wellbore which results in changes in the production rate of the well as the borehole is drilled. By measuring variations in the annular bottomhole pressure during drilling, the local pore pressure along the length of the borehole can be calculated. According to a preferred embodiment pressure changes can be intentionally induced downhole, such as for a gas reservoir by pulsing the liquid injection rate at surface, and for a liquid reservoir by varying the gas injection rate, and monitoring the changes in pressure, so that the local pore pressure can be derived from the transient response of the well.

Figure 2:
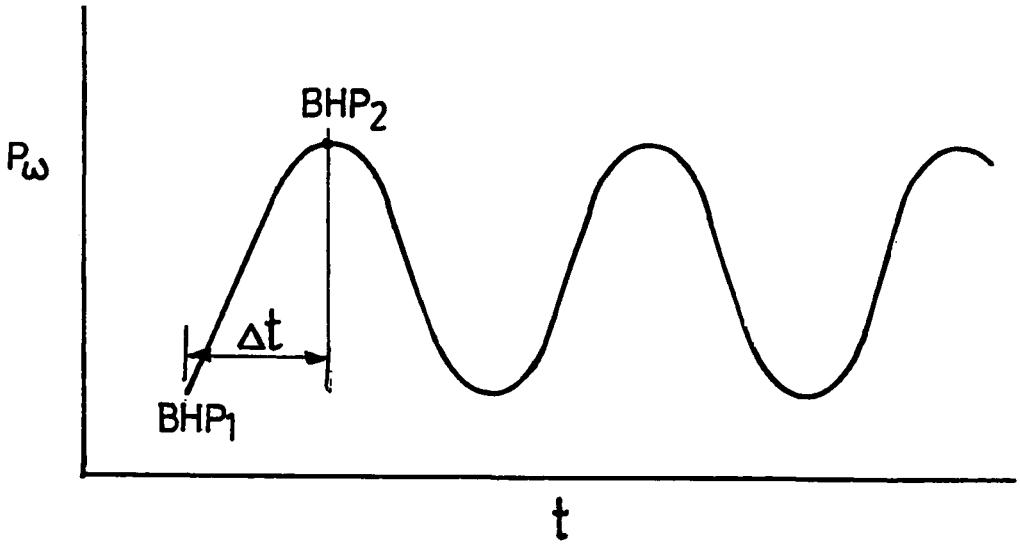
FIG. 2 shows a graph of pressure variation with time.

The variations in pressure can be sinusoidal in nature, as shown in FIG. 2 which illustrates the pressure downhole $P_w$ as a function of time. Stepped changes in pressure can also be used for analysis by the method, and in general, any type of variation in pressure can be used to practice the present invention so long as the rate of change is sufficient for the resolution required. As shown in FIG. 2, if the time $\Delta t$ between annular bottomhole pressure 1 ($BHP_1$) and annular bottomhole pressure 2 ($BHP_2$) is 1 hour, and the drilling rate is 2 m an hour, then the chosen depth of formation $z_1$ is 1 m, and formation $Z_2$ is also 1 m. The more accurately the production flow rate of the well can be measured, the less change in pressure is needed to achieve suitable data for analysis.

The resolution of the pore pressure profile obtained will depend on the resolution and accuracy of the measurements of annular bottomhole pressure and production flow rate made whilst drilling, in conjunction with the rate of penetration (ROP) of the drill bit. For a low ROP compared to the sampling rate of the pressure and flow rate data, the spatial resolution of the pore pressure profile will be high.

According to a preferred embodiment, pore pressure and permeability profiles are simultaneously derived whilst drilling. Thus the assumption of a fixed pore pressure for the length of the borehole can be dispensed with. Furthermore, direct measurement of local drawdown, i.e. (bottomhole pressure–surface pressure)/(pore pressure–wellbore pressure), enhances the accuracy of the derived permeability values.

When analysing the data using artificial layers as shown in FIG. 1, the mass flow rate Q from a segment or section of the reservoir at position $z_1$, drilled at time $t_1$, is described by $$Q(z_1,t_1)=\Delta p(z_1,t_1)\rho U(z_1,t_1)\Delta t_1 \int H dt \quad (1)$$

where $\Delta p(z_1,t_1)$ is the local drawdown, $\rho$ is the density of the produced fluid, $\Delta t_1$ is the duration of drilling the zone, $U(z_1,t_1)$ is the rate of penetration (ROP) of the drill bit (which is a function of time but assumed constant over $\Delta t_1$), and H is the local rate response of the reservoir to the drawdown, which depends on the local reservoir characteristics.

The mass flow rates dQ from a segment of the reservoir at position $z_1$, drilled over time $\Delta t_1$, is described by $$dQ(z_1,t_1)=\Delta p(z_1t_1)\rho U(z_1t_1)\Delta t_1\int Hdt \tag{2}$$

where $\Delta p(z_1,t_1)$ is the local drawdown, equal to $[P_f(z_1,t_1)-P_{BHP}(z_1,t_1)_2]$, $\rho$ is the density of the produced fluid, $U(z_1,t_1)$ is the rate-of-penetration (ROP) which is a function of time but assumed constant over $\Delta t_1$, and H is the local rate response of the reservoir to the drawdown, which depends on the local reservoir characteristics. $P_f$ is the formation pressure and $P_{BHP}$ is the bottomhole pressure.

For a known reservoir pore pressure and porosity profile, this may be used to derive the formation permeability profile.

For a second layer at $z_2$, adjacent to the layer at $z_1$, but drilled at bottomhole pressure $\Delta P_2=P_f(Z_2,t_2)-P_{BHP}(Z_2,t_2)$, where $P_{BHP}(Z_2,t_2)\neq P_{BHP}(z_1,t_1)$, the production rate will change according to $$dQ(z_2,t_2)=\Delta p(z_2,t_2)\rho U(z_2,t_2)\Delta t_2\int Hdt \tag{3}$$

For a sufficiently high data acquisition rate compared to the ROP and the heterogeneity of the reservoir itself, we assume that the reservoir characteristics do not vary significantly between $z_1$ and $Z_2$, and that therefore the rate response, H, is constant between the two, i.e. we assume $$P_f(z_1,t_1)=P_f(z_2,t_2) \tag{4}$$

and the permeability $\kappa$ of $z_1$ and $z_2$ is such that $$\kappa(z_1,t_1)=\kappa(z_2,t_2) \tag{5}$$

and the porosity $\phi$ is $$\phi(z_1,t_1)=\phi(z_2,t_2) \tag{6}$$

The volumetric flow rate from any segment k at bottom hole immediately after drilling may be written $$dq_k = \Delta p_k \frac{4\pi r_w \kappa_k}{\mu} \frac{\Delta z_k}{\log(\Gamma_k)-\gamma} \tag{7}$$

where $r_w$ is the radius of the wellbore, $\mu$ is the viscosity of the produced fluid, $\gamma$ is Euler's constant which equals 1.78, and $$\Gamma_k = \frac{4\kappa_k \Delta t_k}{\phi\mu c_t r_w^2} \tag{8}$$

for $\Delta t_k$ the duration of drilling for segment k, where $c_t$ is the compressibility of fluid flowing in the reservoir.

Note that the flow rate from any zone at bottomhole might be measured at bottomhole, or estimated from surface.

So the volumetric flow rate from the reservoir for segments 1 and 2 immediately on being drilled over equal timescale $\Delta t$ are $$dq_1(t_1) = \left(P_f - P_{BHP}(t_1, z_1)\right)\frac{4\pi\kappa r_w}{\mu}\frac{\Delta z_1}{\log\left(\frac{4\kappa\Delta t}{\phi\mu c_t r_w^2}\right)-\gamma} \tag{9}$$

and $$dq_2(t_2) = \left(P_f - P_{BHP}(t_2, z_2)\right)\frac{4\pi\kappa r_w}{\mu}\frac{\Delta z_2}{\log\left(\frac{4\kappa\Delta t}{\phi\mu c_t r_w^2}\right)-\gamma} \tag{10}$$

where the permeability $\kappa$, pore pressure $P_f$ and porosity $\phi$ of the rock are unknown but the same in each equation. Terms involving the permeability and porosity of the rock are eliminated from these two equations to yield the local pore pressure, $P_f(z)$, applicable to any two such zones, N-1 and N, drilled at constant time interval (for the expression given) but of varying thickness $\Delta z_{N-1}$ and $\Delta z_N$. This is written $$P_f(z) = \frac{\left(dq_{N-1}(t_{N-1})P_{BHP}(t_N)\left[\frac{\Delta z_N}{\Delta z_{N-1}}\right] - dq_N(t_N)P_{BHP}(t_{N-1})\right)}{\left(dq_{N-1}(t_{N-1})\left[\frac{\Delta z_N}{\Delta z_{N-1}}\right] - dq_N(t_N)\right)} \tag{11}$$

In the case that the porosity of the rock is already known, either of the equations (9) or (10) (defining $dq_1(t_1)$ or $dq_2(t_2)$) can be used to derive the permeability $\kappa$.

In the event that the porosity is not known then by considering the flow from a third segment, assumed to have similar reservoir characteristics as segments 1 and 2, drilled at a third bottomhole pressure, three equations with three unknowns are obtained.

The solution method for three simultaneous equations can take many forms. For example, if we drill the third segment, segment 3, over a timescale $\Delta t_n$, where $\Delta t_n\neq\Delta t$, then $$dq_3(t_3) = \left(P_f - P_{BHP}(t_3, z_3)\right)\frac{4\pi\kappa r_w}{\mu}\frac{\Delta z_3}{\log\left(\frac{4\kappa\Delta t_n}{\phi c_t \mu r_w^2}\right)-\gamma} \tag{12}$$

By using the equation describing the flow from segment 1 to write $$\log(\phi) = \log\left(\frac{4\kappa\Delta t}{\mu c_t r_w^2}\right) - \gamma - \left(P_f - P_{BHP}(t_1, z_1)\right)\frac{4\pi\kappa r_w}{dq_1(t_1)\mu}\Delta z_1 \tag{13}$$

and substituting this into the equation (12) to give $$dq_3(t_3) = \left(P_f - P_{BHP}(t_3, z_3)\right)\frac{4\pi\kappa r_w}{\mu}\frac{\Delta z_3}{\log\left(\frac{\Delta t_n}{\Delta t}\right) + \left(P_f - P_{BHP}(t_1, z_1)\right)\frac{4\pi\kappa r_w}{dq_1(t_1)\mu}}\Delta z_1 \tag{14}$$

This is re-arranged to give $$\kappa = \frac{\mu}{4\pi r_w}\log\left(\frac{\Delta t}{\Delta t_n}\right)\left[\left(P_f - P_{BHP}(t_1, z_1)\right)\frac{\Delta t_1}{dq_1(t_1)} - \left(P_f - P_{BHP}(t_3, z_3)\right)\frac{\Delta z_3}{dq_3(t_3)}\right]^{-1} \tag{15}$$

an expression for the permeability of segments 1, 2 and 3.

Since permeability and pore pressure are now defined, equation (13) gives $$\phi = \exp\left[\log\left(\frac{4\kappa\Delta t}{\mu c_t r_w^2}\right) - \gamma - \left(P_f - P_{BHP}(t_1)\right)\frac{4\pi\kappa r_w}{dq_1(t_1)\mu}\Delta z_1\right] \tag{16}$$

the porosity appropriate to segments 1, 2 and 3.

This process may be completed for a series of three segments, drilled at three different bottomhole pressures, throughout the entire drilling operation, to yield pore pressure, permeability, and porosity profile of the near wellbore region, with no prior information regarding these characteristics required.

Note that where no bottomhole flow rate is possible, the formation pressure becomes $$P_f \approx \frac{\left(dq_{N-1}P_{BHP}(t_N, z_N)\left[1 + \frac{\Delta z_N}{\Delta z_{N-1}}\right] - dq_N P_{BHP}(t_{N-1}, z_{N-1})\right)}{\left(dq_{N-1}\left[1 + \frac{\Delta z_n}{\Delta z_{N-1}}\right] - dq_N\right)} \tag{17}$$

where the Q's are the total volumetric output from the entire reservoir at bottomhole (as measured from surface and suitably corrected for bottomhole conditions).

Again, permeability is calculated easily where the porosity is known from either segment.

Alternatively, a similar procedure to that outlined above may be used to determine both permeability and porosity, as well as pore pressure from surface measurements.

If the accuracy of the flow meter requires a target change in flow rate from the two individual zones compared to the total volumetric flow rate, then for detectability we have $$\frac{(dq_N - dq_{N-1})}{q_s(t_N)} = T \tag{18}$$

and writing $P_{BHP}(t_N)=r_N P_{BHP}(t_{N-1})$, then we find $$r_N = 1 - \frac{q_s(t_N)(1-T) - q_s(t_{N-1}) - \frac{4\pi r_w \kappa_{N-1} P_f(t_{N-1})\Delta z_{N-1}}{\mu(\log[\Gamma_{N-1}] - \gamma)}}{P_{BHP}(t_{N-1})\sum_{k=1}^{N(t_N)-1}\frac{4\pi r_w \kappa_k \Delta z_k}{\mu(\log[\Gamma_k] - \gamma)}} \tag{19}$$

Before using the method in accordance with this invention, the required BHP variation $r_N$, may be needed to obtain the target variation in flow rate, T. This can be obtained by using estimates of the formation pressure and permeability. Thereafter, derived values obtained using real data from the well can be used to update the values of $r_N$ and T.

For a spatial resolution R required in the pore pressure profile, a timescale Δt is associated with the annular BHP variations of $$\Delta t_{N-1} = \Delta t_N = \frac{R}{U(t_N) + U(t_{N-1})} \tag{20}$$

The method disclosed here is a means of deriving the reservoir pore pressure profile, real time, whilst drilling underbalanced. In this methodology, variations in bottomhole pressure during underbalanced drilling operations, and the subsequent variations in produced flow rates at surface, are interpreted in a manner which allows the local pore pressure to be obtained to high spatial resolution.

Figures 3A, 3B, 3C:
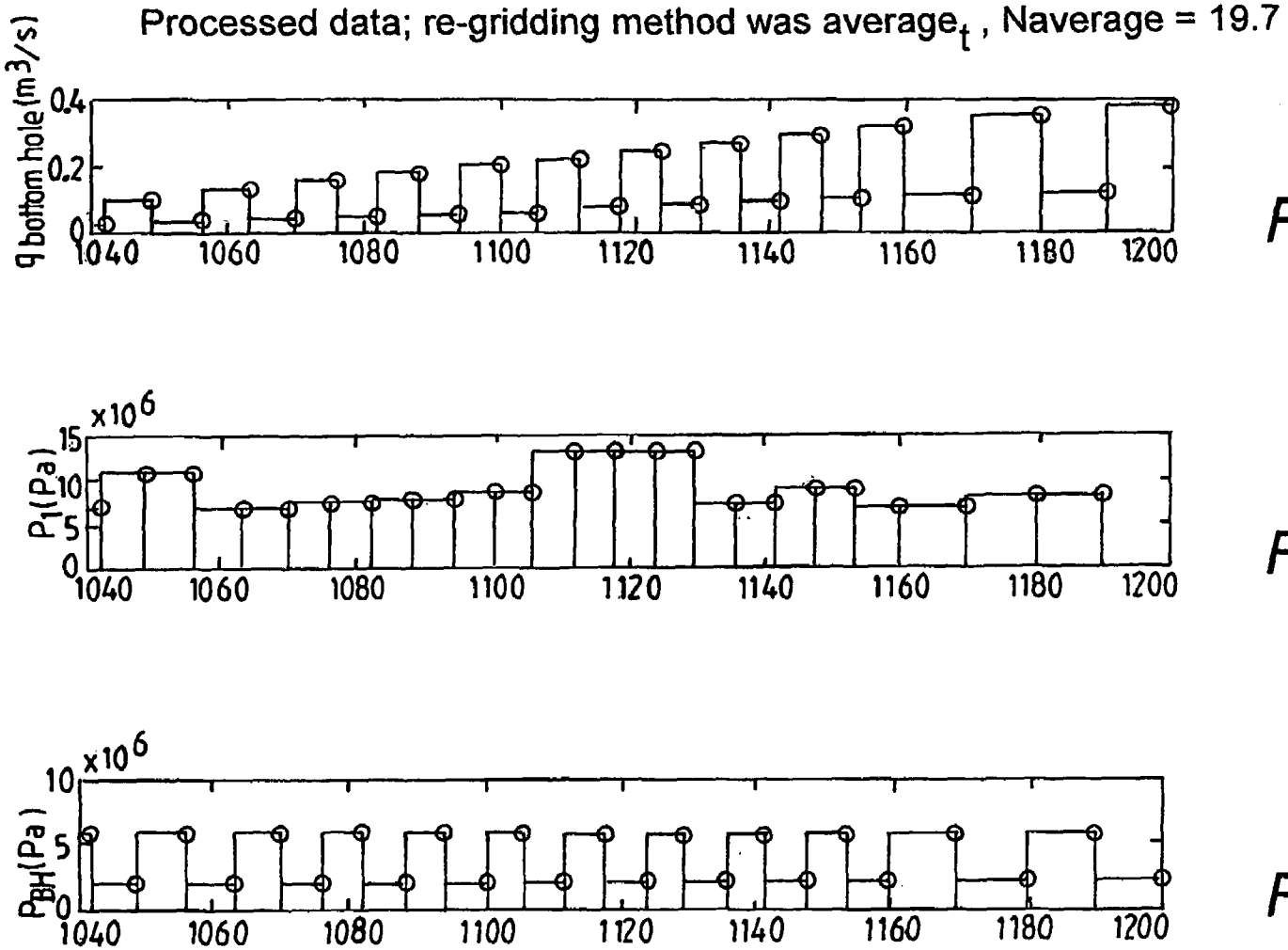
FIG. 3 shows a series of graphs relating to pressure variation downhole and subsequent calculation of properties of formations using a method in accordance with the present invention.
Figure 3D:
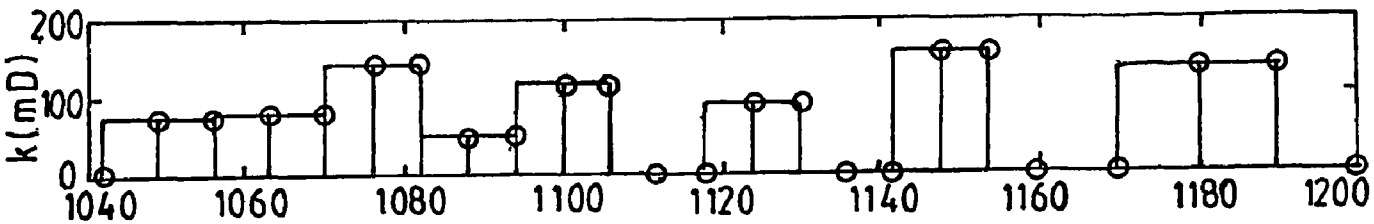
Figure 3E:
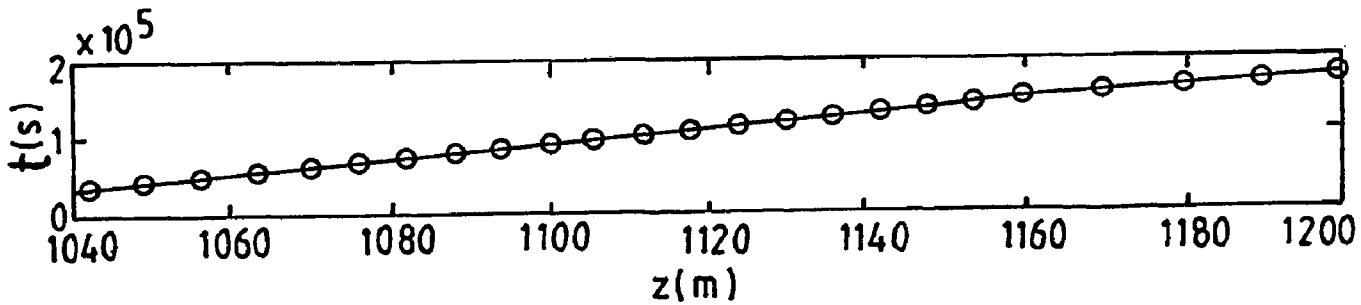

FIG. 3 shows a series of graphs illustrating simulated data and the pore pressure and permeability which can be derived from such data using an algorithm according to the method of the present invention. The same series of graphs can be achieved for real data, using bottomhole pressure over time, measured depth, surface and standpipe pressures and surface flow meter of gas into and out of the wellbore.

FIG. 3(*a*) shows the produced volumetric flux from the reservoir at bottomhole as a function of the distance drilled. FIG. 3(*c*) shows fluctuations in bottomhole annular pressure as a function of the drilling depth. Using this data, and the expressions derived herein, FIG. 3(*b*) shows the pore (or formation) pressure in MPa derived using the changes in pressure as a function of distance, with FIG. 3(*d*) illustrating the permeability profile derived again as a function of distance. FIG. 3(*e*) shows time as a function of measured depth.

Figure 4D:
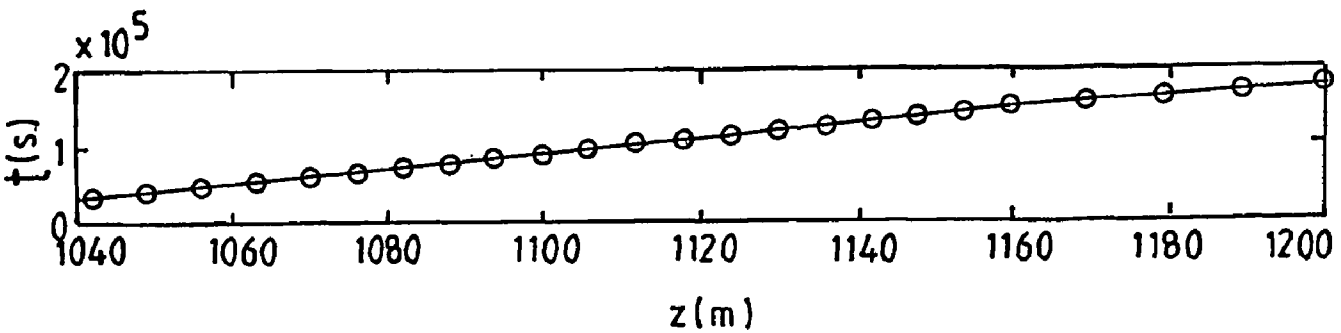
Fig. 4(d) [Prior Art]
FIG. 4 illustrates a series of graphs showing properties obtained using a prior art method.
Figure 4E:
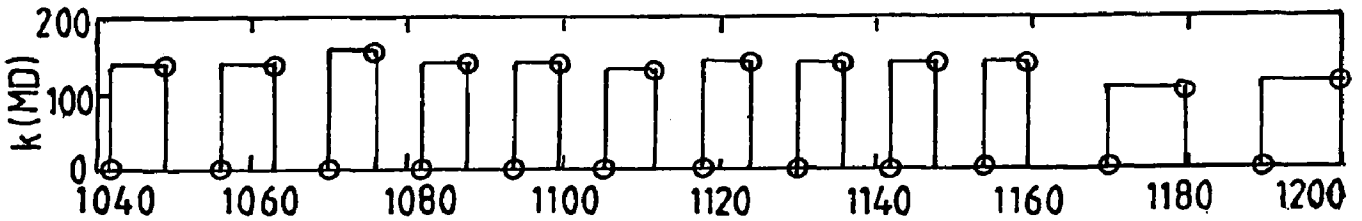
Fig. 4(e) [Prior Art]

FIG. 4 illustrates what is achieved when the same simulated data relating to borehole pressure and production flow is analysed by setting the pore or formation pressure to 10 MPa using a prior art algorithm which derives permeability using an estimated formation pressure. FIG. 4(*a*) shows produced volumetric flux as a function of distance, FIG. 4(*b*) shows the fluctuations in bottomhole annular pressure, FIG. 4(*c*) shows the permeability profile derived using the estimated constant pore pressure of 10 MPa, and FIG. 4(*d*) shows time as a function of measured depth. The prior art algorithm derives an incorrect permeability profile as shown in FIG. 4(*c*) even in the case of a fairly homogenous but non-constant formation pressure profile as shown in FIG. 3(*b*).

The measured variations in BHP shown in the example of FIG. 3 are such that detectable variations in gas flow at surface may be derived over periods of one, to several hours. Accuracy of production rates is facilitated in these cases by adopting a steady injection rate.

The present invention can be used by measuring unintentionally caused pressure variations such as from uncontrolled variations in the mud pumping speed or variability of influx from the reservoir. Thus, unintentional variations in pressure can be used, so long as the rate change is sufficient for the resolution required given the particular drilling situation (for example, the rate of penetration, flow measurement accuracy).

According to another embodiment of the present invention, the pressure variations can be intentionally induced. According to a preferred embodiment the composition of the drilling fluid can be changed during drilling. This can be accomplished for example by changing the ratio of gas to liquid in the drilling fluid. Pressure variations can also be induced by changing the pumping rates of the drilling fluid, or actuating a moveable constriction in the system either downhole or on the surface. According to another preferred embodiment, the annular pressure of the drilling fluid at the surface can be altered using a choke unit. The variations can also be induced using a specially shaped section of pipe or nozzle that causes a resonance in the fluid pressure.

Figure 5:
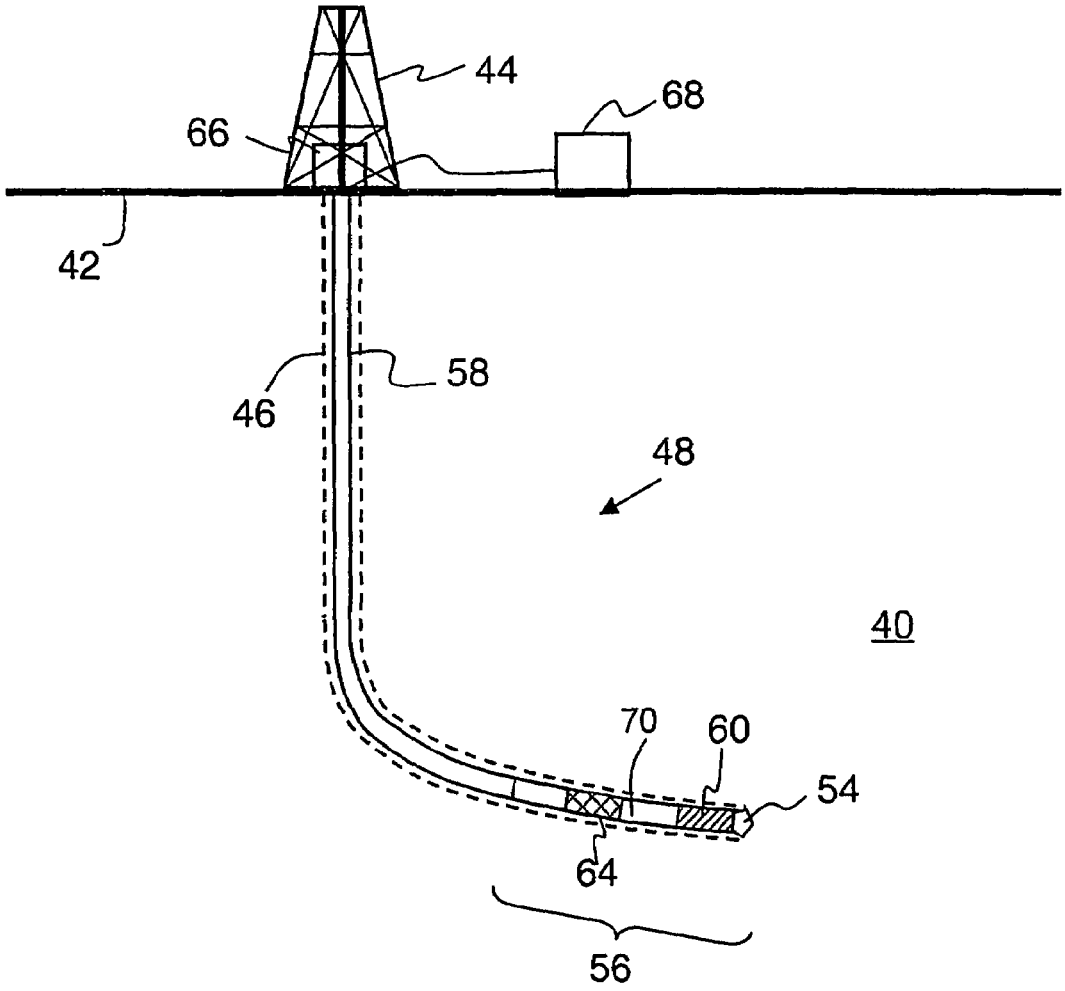
FIG. 5 shows a system for calculating properties relating to a subterranean formation, according to a preferred embodiment of the invention.

FIG. 5 shows a system for calculating properties relating to a subterranean formation, according to a preferred embodiment of the invention. Although derrick 44 is shown placed on a land surface 42, the invention is also applicable to offshore and transition zone drilling operations. Borehole 46, shown in dashed lines, is being formed in the subterranean formation 40 using bit 54 and drill string 58. The lower portion of drill string 58 comprises a bottom hole assembly ("BHA") 56. The BHA 56 in turn, comprises a number of devices, including annular pressure sensor 60, downhole flowmeter 70 and telemetry subassembly 64.

At the surface 42, are located the circulating system, not shown, for circulating the drilling fluid (which includes the mud pumps), rotating system, not shown, to rotate the drill string and drill bit, and a hoisting system, not shown, for suspending the drill string with the proper force.

According to the invention, data from the pressure sensor 60 and flow meter 70 are transmitted to the telemetry subassembly 64 via a cable, not shown. Telemetry subassembly 64 then converts the data from electrical form to some other form of signals, such as mud pulses. However, Telemetry subassembly 64 could use other types of telemetry such as torsional waves, in drill string 58, or an electrical connection via a cable. The telemetry signals from subassembly 64 are received by a receiver, not shown, located in surface equipment 66. The receiver converts the telemetry signals back into electronic form (if necessary) and then transmits the data to a logging unit 68 for recording and further processing. Logging unit 68 comprises a computer/data processor, data storage, display and control logic.

Also preferably provided in surface equipment 66 is are surface fluid pressure sensors that (1) measure the pressure of the fluid coming out of the annulus (i.e. the annular region between drillstring 58 and the borehole wall of borehole 46, and (2) measure the standpipe pressure (i.e. the pressure of the fluid inside the drillstring 58). Surface equipment 66 also preferably comprises flow sensors that measure the flow rates of both injection and outflow. According to another embodiment of the invention, a choke unit is provided in surface equipment 66 for altering the pressure of the fluid.

According to an alternative embodiment, a coiled tubing drilling arrangement is used instead of derrick 66, and drillstring 58. In this case the data from flow meter 70 and pressure sensor 60 is transmitted via a wireline connection to the surface.

In operation, the computer located in logging unit 68 is used to calculate the properties such as pore pressure, porosity, and permeability using the data from the various sensors, according to the invention as herein described.

Figure 6:
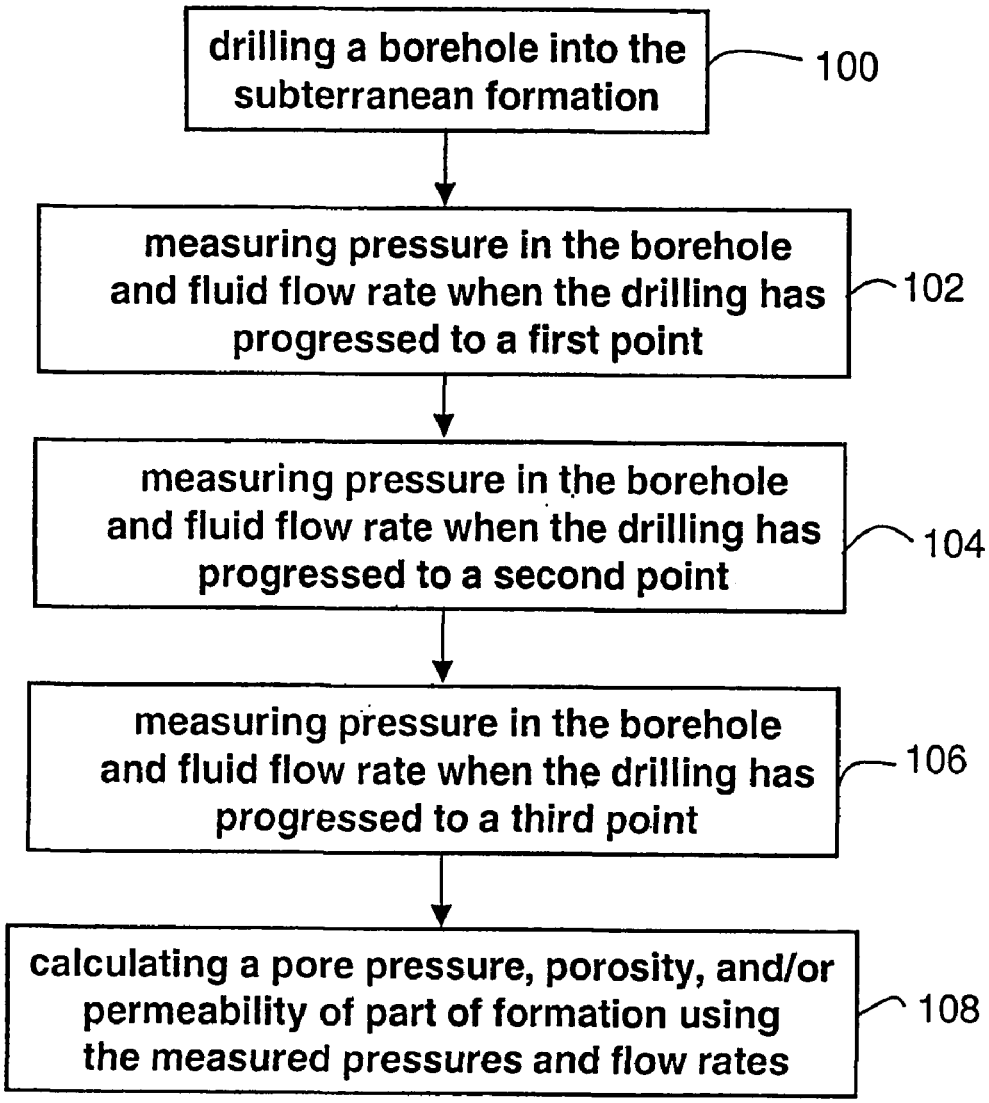
FIG. 6 shows steps involved in calculating properties relating to a subterranean formation, according to a preferred embodiment of the invention.

FIG. 6 shows steps involved in calculating properties relating to a subterranean formation, according to a preferred embodiment of the invention. Step 100 is the drilling process in which the borehole is formed in the subterranean formation. Although step 100 is shown as the first step in FIG. 6, in practice the other steps of the invention (e.g. step 102 to 108 in FIG. 6) are carried out during the drilling step 100. In step 102 the pressure and fluid flow rates are measured when the drilling has progressed to a certain point, or depth. According to preferred embodiment described above, the pressure in the borehole is measured using an annular pressure sensor located in the bottom hole assembly, and the fluid flow rate is either measured at the surface, or using a downhole flow meter. Additionally, although the drilling process 100 can be stopped during the measurement, according to a preferred embodiment, the measurements are taken as the drilling proceeds. In steps 104 and 106 the same or similar measurements are taken when the drilling has progressed to two other points. Finally, in step 108 the properties of the formation are calculated using the measurements. As has been described above, if only one or two properties are being calculated, then measurement from only two of the three locations are preferably used in the calculation step.

The above-described embodiments are illustrative of the invention only and are not intended to limit the scope of the present invention.

What is claimed is:

1. A method of calculating properties relating to a subterranean formation, comprising the steps of:

drilling a borehole into the subterranean formation;

measuring a first pressure in the borehole when the drilling has progressed to a first location in the formation;

measuring a first fluid flow rate when the drilling has progressed to the first location;

measuring a second pressure in the borehole when the drilling has progressed to a second location in the formation;

measuring a second fluid flow rate when the drilling has progressed to the second location;

calculating a property of at least a portion of the formation using the first and second pressures and the first and second fluid flow rates; and outputting the calculated property to a user.

2. The method of claim 1, wherein the first and second fluid flow rates are measurements of fluid exiting the borehole at or near the surface.

3. The method of claim 1, wherein the first and second fluid flow rates are measurements of fluid flowing in the borehole in close proximity to the first and second locations respectively.

4. The method of claim 1, wherein the first and second pressures are annular bottomhole pressures.

5. The method of claim 1, wherein the step of calculating comprises calculating at least two of the following types of properties: pore pressure, porosity, and permeability.

6. The method of claim 1, wherein the method further comprises:

measuring a third pressure in the borehole when the drilling has progressed to a third location in the formation; and measuring a third fluid flow rate when the drilling has progressed to the third location, wherein the step of calculating makes use of the third pressure and the third flow rate.

7. The method of claim 6, wherein the step of calculating comprises calculating the following types of properties: pore pressure, porosity, and permeability.

8. A method according to claim 1, wherein variations in pressure in the borehole are induced by altering the flow rate of drilling fluid.

9. A method according to claim 1, wherein variations in pressure are induced by placing a tool in the borehole which emits acoustic pulses into fluid within the well.

10. A method according to claim 1, wherein variations in pressure are induced by altering the density of drilling fluid used.

11. A method according to claim 1, wherein the pressure variations are induced by a choke unit.

12. A method according to claim 1, wherein variations in pressure are caused in part by unintentional variations in pumping of drilling fluid.

13. A method according to claim 1, wherein data reflecting the measured pressures are communicated to the surface using mud-pulse telemetry.

14. A method according to claim 1, wherein the pressures are measured by placing a sensor in the borehole as part of a bottom hole assembly.

15. A method according to claim 1, wherein the step of calculating comprises using a first relationship between the first flow rate and the first pressure, a second relationship between the second flow rate and the second pressure, and solving the first and second relationships to obtain a value for the property.

16. A method according to claim 15, wherein the first and second relationships express flow rates as a function of well bore conditions and reservoir characteristics.

17. A method according to claim 16, wherein the first and second relationships express the measured flow rates as a function of drawdown, rate of penetration, and the rate response of a portion of the formation.

18. A method according to claim 1, further comprising obtaining a profile of formation properties along the length of a borehole.

19. A method according to claim 1, wherein the step of drilling is not interrupted during the measurement steps.

20. The method of claim 1, wherein the user is a person or a computer and the person or computer uses the calculated property to control a drilling fluid pressure.

21. A system for calculating properties relating to a subterranean formation, comprising:

a pressure sensor configured to measure pressures in a borehole in the formation in close proximity to a drill bit used to drill the borehole;

a flow sensor configured to measure flow rates of fluid flowing through the borehole;

a processor adapted to calculate a property of at least a portion of the formation using first and second measured pressures and first and second fluid flow rates, wherein the first and second pressures are measured by the pressure sensor when the drilling has progressed to a first and second location respectively, and the first and second flow rates are measured by the flow sensor when the drilling has progressed to a first and second location respectively; and a display configured to display the calculated property to a user.

22. The system of claim 21, wherein the flow sensor measures fluid exiting the borehole at or near the surface.

23. The system of claim 21, wherein the flow sensor is located in a bottom hole assembly and measures fluid flowing in the borehole.

24. The system of claim 21, wherein the pressure sensor is located in a bottom hole assembly and measures annular bottomhole pressure.

25. The system of claim 21, wherein the processor calculating at least two of the following types of properties: pore pressure, porosity, and permeability.

26. The system of claim 21, wherein the pressure sensor measures a third pressure in the borehole when the drilling has progressed to a third location in the formation, the flow sensor measures a third fluid flow rate when the drilling has progressed to the third location, and the processor makes use of the third pressure and the third flow rate.

27. The system of claim 26, wherein the processor at least calculates the following types of properties: pore pressure, porosity, and permeability.

28. The system according to claim 21, wherein the processor use a first relationship between the first flow rate and the first pressure, a second relationship between the second flow rate and the second pressure, and solving the first and second relationships to obtain a value for the property.

29. A system according to claim 28, wherein the first and second relationships express flow rates as a function of well bore conditions and reservoir characteristics.

* * * * *